US012117257B1

(12) United States Patent
Vanaken

(10) Patent No.: US 12,117,257 B1
(45) Date of Patent: Oct. 15, 2024

(54) RECOIL REDUCING ELECTROMAGNET SYSTEM FOR FIREARMS

(71) Applicant: Ryan Vanaken, San Diego, CA (US)

(72) Inventor: Ryan Vanaken, San Diego, CA (US)

( * ) Notice: Subject to any disclaimer, the term of this patent is extended or adjusted under 35 U.S.C. 154(b) by 0 days.

(21) Appl. No.: 18/211,648

(22) Filed: Jun. 20, 2023

Related U.S. Application Data

(60) Provisional application No. 63/405,283, filed on Sep. 9, 2022.

(51) Int. Cl.
*F41A 19/59* (2006.01)
*F41A 1/08* (2006.01)
*F41A 19/61* (2006.01)

(52) U.S. Cl.
CPC ..... *F41A 19/59* (2013.01); *F41A 1/08* (2013.01); *F41A 19/61* (2013.01)

(58) Field of Classification Search
CPC ..... F41A 3/78; F41A 25/16
USPC ..... 42/84; 89/37.14, 198
See application file for complete search history.

(56) References Cited

U.S. PATENT DOCUMENTS

| | | | | |
|---|---|---|---|---|
| 2,818,783 | A | 1/1958 | Carlson et al. | |
| 4,527,457 | A * | 7/1985 | Fikse | F41B 6/006 318/135 |
| 6,343,536 | B1 | 2/2002 | Rossier et al. | |
| 6,644,168 | B1 | 11/2003 | Browne et al. | |
| 7,380,487 | B2 | 6/2008 | Mantras | |
| 7,525,203 | B1 | 4/2009 | Racho | |
| 8,176,668 | B2 | 5/2012 | Simms et al. | |
| 9,829,266 | B1 * | 11/2017 | Shaver | F41A 25/26 |
| 9,995,551 | B2 | 6/2018 | Whitfield, Jr. | |
| 10,088,266 | B1 * | 10/2018 | Fournerat | F41C 23/06 |
| 11,150,047 | B2 | 10/2021 | Griffin | |
| 11,187,477 | B2 | 11/2021 | Snyder | |
| 11,378,347 | B2 | 7/2022 | Kincel et al. | |
| 2002/0178901 | A1 | 12/2002 | Bergstrom | |
| 2015/0226507 | A1 | 8/2015 | Palmer | |
| 2018/0087864 | A1 * | 3/2018 | Lowrance | F41A 9/34 |
| 2023/0022447 | A1 * | 1/2023 | McWilliam | F41A 25/10 |

FOREIGN PATENT DOCUMENTS

| | | | |
|---|---|---|---|
| RU | 2752150 | C1 | 7/2021 |
| WO | 2004070306 | A1 | 8/2004 |
| WO | WO-2018019621 | A1 * | 2/2018 |

* cited by examiner

*Primary Examiner* — Bret Hayes
(74) *Attorney, Agent, or Firm* — John Rizvi; John Rizvi, PA—The Patent Professor

(57) ABSTRACT

An electromagnetic system coupled to a firearm, the firearm including a bolt movable rearward and frontward along a rear-to-front axial direction between a forward position and a rearward position, includes a first electromagnet unit. The first electromagnet unit includes at least one electrically-conductive coil and at least one magnet. The magnet or magnets are movable jointly with the bolt in the axial direction with respect to the at least one electrically-conductive coil. The at least one electrically-conductive coil is configured to generate at least one magnetic field that opposes a rearward movement of the at least one magnet in the axial direction and thereby reduces a rearward recoil of the bolt.

20 Claims, 9 Drawing Sheets

RECOIL REDUCING ELECTROMAGNET SYSTEM FOR FIREARMS

CROSS-REFERENCE TO RELATED APPLICATION

This application claims the benefit of U.S. Provisional Patent Application No. 63/405,283, filed on Sep. 9, 2022, which is incorporated herein by reference in its entirety.

FIELD OF THE INVENTION

The present invention relates generally to recoil systems for firearms, and more particularly, to an electromagnet system for use with a firearm that causes a reduction in recoil force of the firearm.

BACKGROUND OF THE INVENTION

Generally, firearms include a chamber in which a cartridge with a bullet is loaded. In order to fire the bullet from the firearm, a trigger is pulled. The trigger causes a firing pin to contact a rear end of the cartridge and thus igniting explosive charges in a primer within the cartridge. The primer ignites a propellant which burns and generates pressure to eject a bullet at a high speed from the firearm. When the bullet is ejected, the bullet exerts an equal force in the opposite direction in accordance with laws of physics. This causes a rearward force on the firearm, particularly on a bolt of the firearm, which is felt by a user firing the firearm. This rearward force is referred to as a recoil of the firearm.

Recoil of a firearm causes physical stress to a user firing the firearm and reduces the comfort while firing the firearm. High recoil force also leads to loss of accuracy, specifically when firing multiple rounds in a short period of time. Recoil pads may be used by users firing the firearm. However, recoil pads are an additional accessory and do not reduce the recoil force of the firearm.

Accordingly, there is an established need for a solution to the problems mentioned above. For instance, there is an established need for a system coupled to a firearm that reduces a recoil force that is felt by a user firing the firearm. Further, there is an established need for a system that can be coupled to the firearm in an effective manner.

SUMMARY OF THE INVENTION

The present invention relates to an electromagnetic system coupled to a firearm. The firearm has a bolt movable between a forward position and a rearward position. The electromagnetic system comprises a first electromagnet unit comprising a conducting coil and a magnet, wherein the magnet is coupled to the bolt, and wherein the conducting coil is configured to generate a magnetic field that opposes a movement of the bolt from the forward position to the rearward position. The electromagnetic system further comprises a second electromagnet unit comprising a generator coil, a generator magnet, and a connector connecting the generator magnet to the bolt such that movement of the bolt causes movement of the generator magnet, wherein the movement of the generator magnet is configured to induce a current in the generator coil. The electromagnetic system further comprises a power source in electrical connection with the conducting coil and the generator coil, wherein the power source is configured to receive induced current from the generator coil, and wherein the power source is configured to provide electric current to the conducting coil in order to facilitate generation of the magnetic field.

In an aspect, movement of the bolt causes movement of the magnet and the generator magnet in a same direction.

In an aspect, the first electromagnet unit is disposed within a stock of the firearm.

In an aspect, the second electromagnet unit is disposed adjacent a firing chamber of the firearm.

In an aspect, the first electromagnet unit opposing a movement of the bolt from the forward position to the rearward position causes a reduction in recoil force.

In an aspect, the present invention is directed to a firearm comprising a first electromagnet unit, a second electromagnet unit, and a power source.

These and other objects, features, and advantages of the present invention will become more readily apparent from the attached drawings and the detailed description of the embodiments and examples, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
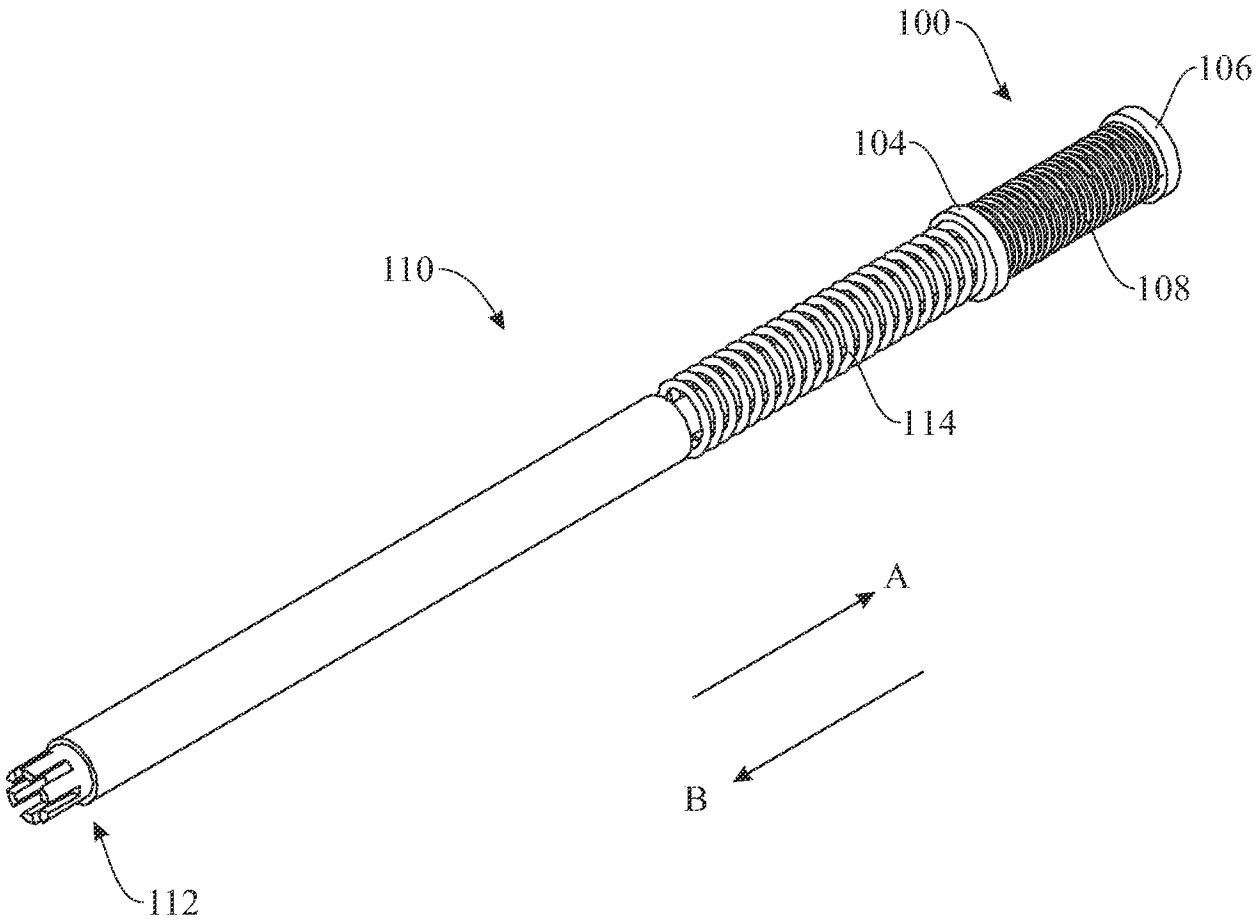
FIG. 1 illustrates a perspective view of a bolt of a firearm having a first electromagnet unit coupled thereto, in accordance with an embodiment of the present specification.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other embodiments. All of the embodiments described below are exemplary embodiments provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well-known elements associated with firearms and components thereof have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

As used in this specification and the appended claims, the singular forms "a," "an," and "the" include plural referents unless the content clearly dictates otherwise, and the vice versa. It should also be noted that the term "or" is generally employed in its broadest sense, that is, as meaning "and/or" unless the content clearly dictates otherwise.

Figure 2:
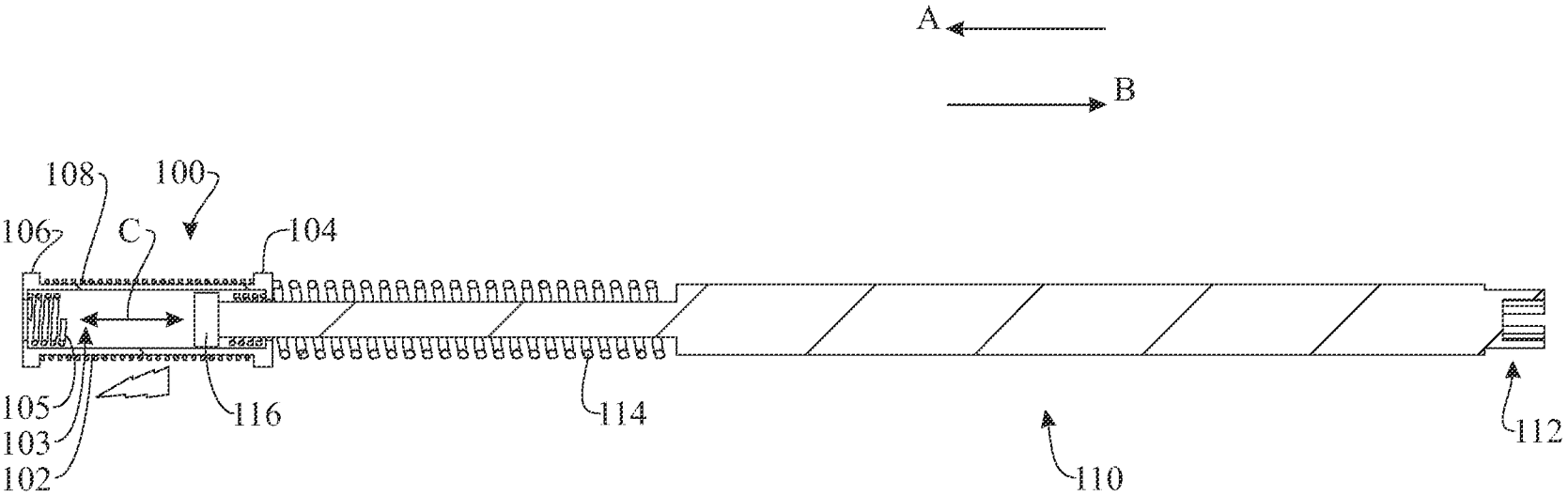
FIG. 2 illustrates a side sectional view of the bolt and the first electromagnet unit of FIG. 1, in accordance with an embodiment of the present specification.

Reference is initially made to FIGS. 1-2 in which FIG. 1 illustrates a perspective view of a bolt 110 of a firearm having a first electromagnet unit 100 coupled thereto while FIG. 2 illustrates a side sectional view of the bolt 110 and the first electromagnet unit 100. The bolt 110 refers to the component in a firearm that facilitates loading of cartridge in a firearm as well as unloading of an empty cartridge from the firearm after use.

A firearm, for instance a semi-automatic firearm, generally comprises a firing chamber in which cartridges are positioned for firing. The cartridges are initially positioned in a magazine and for loading of a cartridge, the bolt interacts with the cartridge in the magazine and moves forward thereby shifting the cartridge into the firing chamber. Upon pulling a trigger of the firearm, a firing pin interacts with the cartridge for activating the bullet which is then fired from the firearm at high velocity. Post the firing of the bullet, the bolt retracts rearward and pulls the empty cartridge which is extracted from the firing chamber by means of an extractor. One firing round is thus completed. For a second round, the bolt again moves forward to load another cartridge and the same steps are repeated for firing and extraction of cartridges.

It is appreciated that the term 'forward' and 'rearward' refers to directions along a longitudinal axis of a firearm. A firearm generally has a barrel opening through which the bullet escapes the firearm and a stock which acts as a shoulder support portion and provides structural support. As used herein, the forward direction refers to a direction moving from the stock to the barrel opening, and the rearward direction refers to direction moving from the barrel opening to the stock.

Further, the firearm additionally comprises a recoil spring positioned at a rear of the bolt configured to contain the recoil when the firearm is fired. The force generated upon firing causes the firearm to pull back towards a user and the recoil spring works to lessen the impact of the recoil force that the user receives from the pull back of the firearm.

As seen in FIGS. 1-2, the bolt 110 comprises an engaging portion 112 at a forward end thereof, the engaging portion 112 being configured for loading and unloading of a cartridge. A recoil spring 114 is coupled around a rear end of the bolt 110, the recoil spring 114 being configured to absorb recoil of the firearm. When the firearm is fired, the bolt 110 moves in the direction A thereby compressing the recoil spring 114. Thereafter, the recoil spring 114 decompresses and moves the bolt 110 in the direction B back to the original position.

As shown in FIG. 2, the bolt 110 of the present disclosure comprises a magnet 116 at the rear end of the bolt 110. In some embodiments, the magnet 116 is a permanent magnet. In some embodiments, the magnet 116 forms an integral part of the bolt 110. In some embodiments, the magnet 116 is connected to the bolt 110. As the bolt 110 moves axially in the directions A and B, the magnet 116 is also caused to move together with the bolt 110. In some embodiments, the magnet 116 acts as a buffer weight for the bolt 110 and may be configured to have a predetermined weight.

The first electromagnet unit 100 is coupled to the bolt 110 at the rear end of the bolt 110. The first electromagnet unit 100 comprises a housing 102 extending between rims 104 and 106. In some embodiments, the housing 102 is a hollow body defining a chamber or interior space 103, the interior space 103 configured to receive the magnet 116 of the bolt 110. The interior space 103 of the housing 102 further allows the magnet 116 to be displaced forwardly and rearwardly there within, as shown by arrow C in FIG. 2. In some embodiments, the magnet 116 forms a component of the first electromagnet unit 100, the magnet 116 being attached to the bolt 110.

The first electromagnet unit 100 further comprises a conducting coil 108 disposed over and wound on the housing 102. The conducting coil 108 is formed of a conducting material having a high electrical conductivity. Some non-limiting examples of materials for the conducting coil 108 include copper, copper-beryllium, copper coated aluminum, brass and aluminum alloy, etc. In some embodiments, the conducting coil 108 forms a solenoid. In some embodiments, the conducting coil 108 assumes a spiral or helix shape. In some embodiments, the conducting coil 108 may be formed of multiple smaller coils.

The conducting coil 108 is in electrical connection with a power source (e.g., power source 125 shown in FIG. 4) that causes a current to pass through the conducting coil 108. When a current passes through the conducting coil 108, a magnetic field is generated based on the principles of Ampere-Maxwell law. As would be understood to a skilled person, the direction of the magnetic field would depend on the direction of flow of current in the conducting coil 108.

When the bolt 110 moves rearward in the direction A due to the recoil force generated upon firing the firearm, the magnet 116 also moves rearward within the chamber or interior space 103 of the housing 102. The current flowing in the conducting coil 108 causes generation of a magnetic field that opposes the movement of the magnet 116 within the chamber 102, i.e., the generated magnetic field has an opposite polarity to the magnet 116. It is appreciated that the direction of current flowing in the conducting coil 108 can be predetermined based on the direction of magnetic field to be generated.

In some embodiments, when the magnet 116 moves rearward during recoil (in direction A), the current in the conducting coil 108 is made to flow such that the generated magnetic field of the conducting coil 108 opposes the movement of the magnet 116; when the magnet 116 moves forward (for loading next round) in direction B, the current in the conducting coil 108 may supplement the movement of the magnet 116. In some embodiments, when the magnet 116 moves forward, the current in the conducting coil 108 may be stopped.

In some embodiments, the current in the conducting coil 108 may be made to flow such that the magnetic field holds the bolt 110 in the rearward position, thus allowing more control of the bolt 110 as well as facilitating various bolt settings. For instance, the bolt 110 may be held back in the rearward position after firing of a round in order to prevent the loss of empty cartridges (shell casings) extracted from the firearm after firing.

In some embodiments, the first electromagnet unit 100 may comprise biasing means 105 (e.g., a compression spring) within the chamber or interior space 103 of the housing 102 that compresses when the magnet 116 interacts therewith during the rearward movement, thereby absorbing energy from the bolt 110 and dampening the rearward movement of the bolt 110, and decompresses to facilitate the forward movement of the magnet 116 and bolt 110.

Accordingly, the first electromagnet unit 100 acts as a recoil absorbing means that reduces the recoil felt by a user during firing of a firearm by virtue of the magnetic repulsion between the magnetic field generated by the conducting coil 108 and the magnet 116 of the bolt 110, and optionally by virtue of the biasing means 105.

Figure 3:
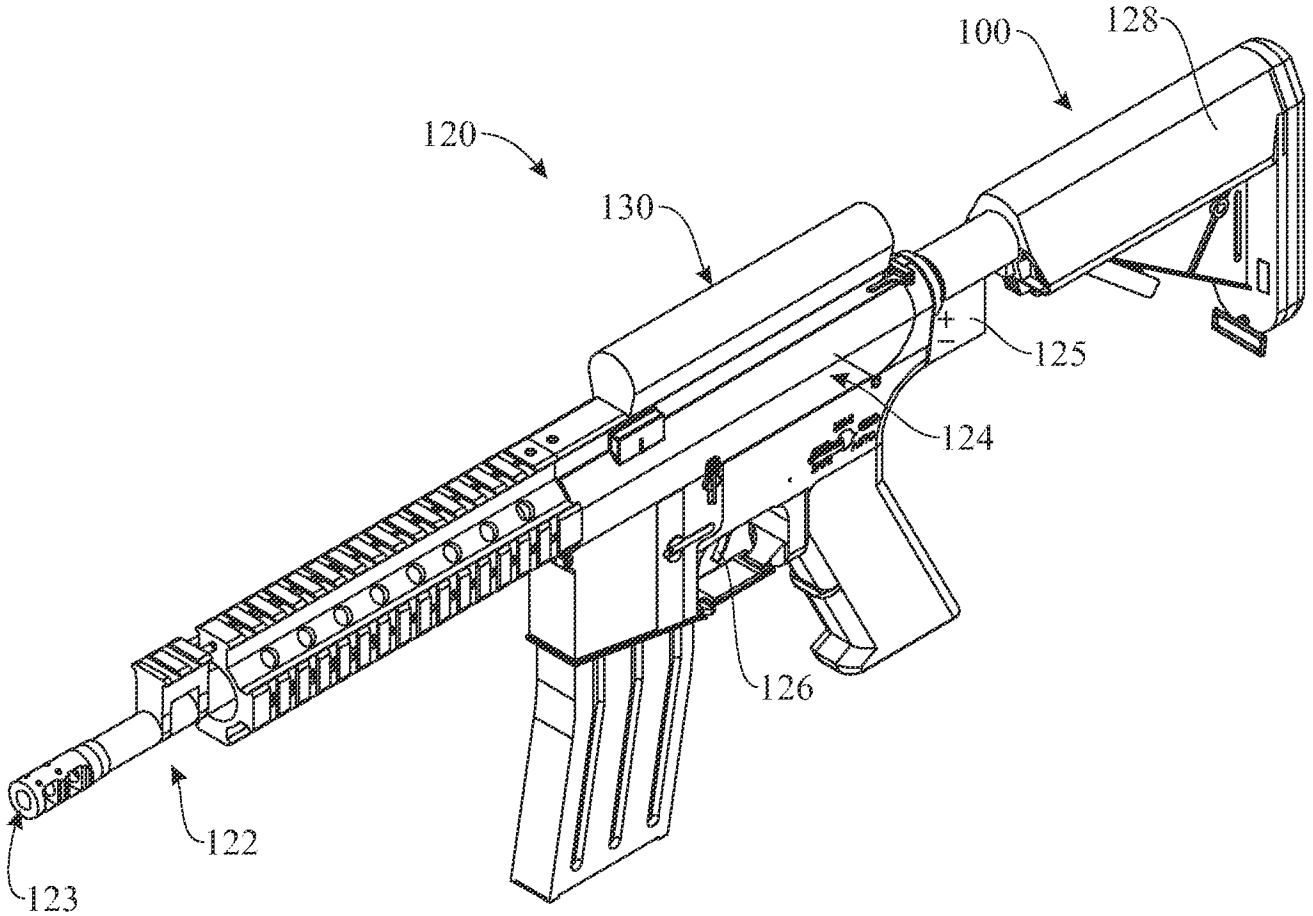
FIG. 3 illustrates a perspective view of a firearm comprising the first electromagnet unit and a second electromagnet unit, in accordance with an embodiment of the present specification.
Figure 4:
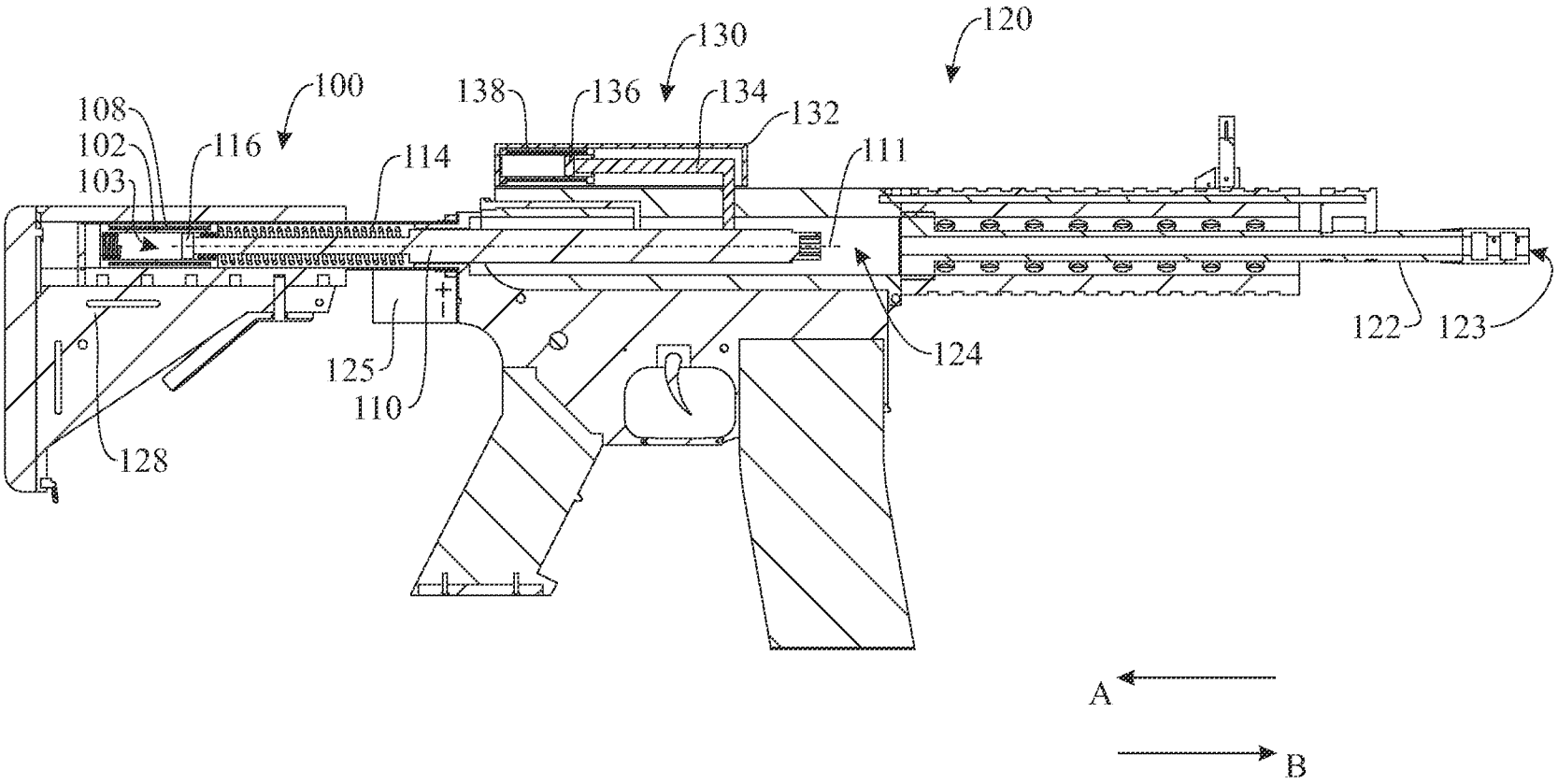
FIG. 4 illustrates a sectional side view of the firearm of FIG. 3, the bolt being in a forward position, in accordance with one embodiment of the present specification.

Reference is made to FIG. 3, which illustrates a perspective view of a firearm 120 comprising the first electromagnet unit 100 and the bolt 110 described above with reference to FIGS. 1-2. The firearm 120 comprises a barrel 122 ending in a distal, barrel opening 123, through which a bullet exits the firearm when fired. The firearm 120 further includes a firing chamber 124 which houses a cartridge to be fired and the bolt 110, as best shown in FIG. 4. The firearm 120 comprises a trigger 126 that leads to firing of the bullet from a loaded cartridge. The firearm 120 further comprises a stock 128 that forms a shoulder support for a user firing the firearm 120.

As shown in FIG. 4, the first electromagnet unit 100 is positioned within the stock 128 of the firearm 120. The bolt 110 extends from the firing chamber 124 at least partially within the stock 128. The housing 102 is arranged within the stock 128, and the bolt 110 extends into the interior space 103 of the housing 102 as heretofore described. The firearm 120 comprises a power source 125 configured to provide supply of current to the conducting coil 108 of the first electromagnet unit 100 causing generation of a magnetic field for reducing recoil effect when the firearm is fired by a user, as heretofore described. In some embodiments, the power source 125 is a rechargeable battery. In some embodiments, the power source 125 is electrically connected to the conducting coil 108 of the first electromagnet unit 100 by a wired connection. In some embodiments, the power source 125 may be at least partially powered by solar power.

Figure 5:
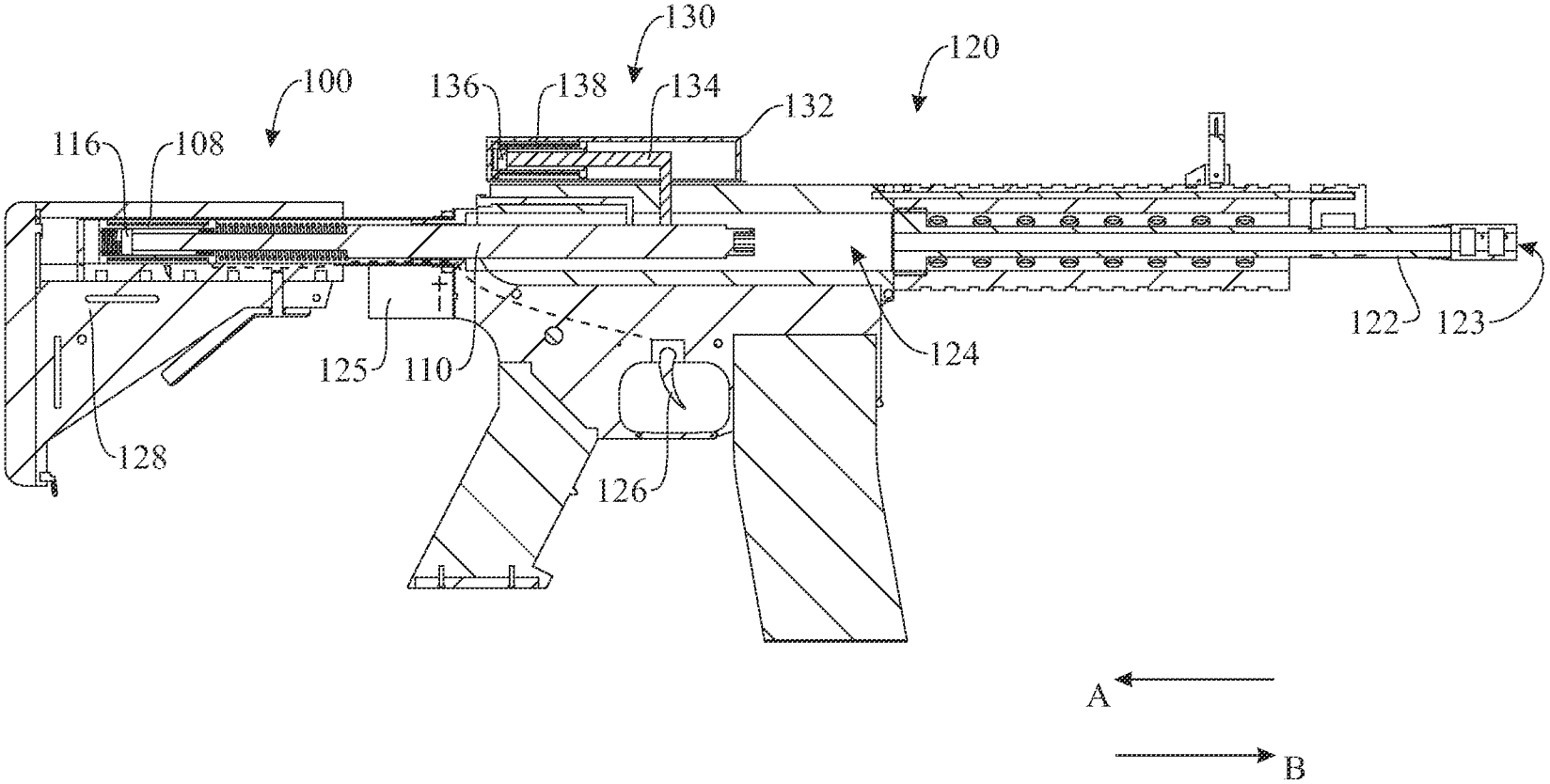
FIG. 5 illustrates a sectional side view of the firearm of FIG. 3, the bolt being in a rearward position, in accordance with one embodiment of the present specification.

As shown in FIGS. 3-5, the firearm 120 further comprises a second electromagnet unit 130 coupled to the firearm 120, the second electromagnet unit 130 being configured to facilitate generation of electric energy, as will be described further below. The first electromagnet unit 100 together with the second electromagnet unit 130 forms an electromagnetic recoil control system that can be utilized with the firearm 120 for efficiently reducing the recoil felt by a user firing the firearm 120. Alternatively or additionally, the second electromagnet unit 130 may be used to provide electrical power to another device, such as, but not limited to, a red dot sight. The electrical current generated by the second electromagnetic unit 130 may be rectified, such as by a diode rectifier, and/or stored, such as by a capacitor bank, prior to delivering the electrical power to the red dot sight or other electrical device. In some embodiments, the electromagnetic recoil system may allow the user to set and adjust multiple recoil parameters.

Reference is made to FIGS. 4-5 illustrating a sectional side view of the firearm 120 with the electromagnetic recoil control system attached thereto, where FIG. 4 illustrates the bolt 110 in a forward position, and FIG. 5 illustrates the bolt 110 in a rearward position. The bolt 110 is disposed in the firing chamber 124 and extends as least partially within the stock 128, as heretofore described. The bolt 110 is configured to move forward and rearward during use of the firearm, in that, the bolt 110 moves rearward in direction A (also seen in FIGS. 1-2) due to recoil force and to extract a fired cartridge while the bolt 110 moves forward in direction B (also seen in FIGS. 1-2) to load the next cartridge for firing.

The second electromagnet unit 130 comprises a housing 132 that is attached to the firearm 120, for instance, adjacent the firing chamber 124 of the firearm 120. In some embodiments, the housing 132 is a hollow container allowing one or components to move there-within. The second electromagnet unit 130 further comprises a connector 134 disposed within the housing 132 and attached to the bolt 110 such that movement of the bolt 110 results in movement of the connector 134 in the same direction. In some embodiments, the connector 134 is fixedly attached to the bolt 110. In some embodiments, the connector 134 is detachably attached to the bolt 110.

The connector 134 comprises a generator magnet 136. The generator magnet 136 is provided at a free end portion of the connector 134, opposite to the end of the connector 134 which is attached to the bolt 110. The generator magnet 136 moves together with the connector 134 within the housing 132. Thus, the generator magnet 136, connector 134 and bolt 110 are jointly movable in the axial direction (directions A and B). The housing 132 further comprises a generator coil 138 disposed therein. The generator coil 138 may have a hollow spiral or helical configuration so as to allow the generator magnet 136 to freely move therethrough. In some embodiments, the generator coil 138 may be formed of multiple smaller coils. In some embodiments, such as the present embodiment, the generator coil 138, the generator magnet 136, and the housing 132 are arranged radially offset from the bolt 110 with respect to a central longitudinal axis 111 of the bolt 110.

Initially, the bolt 110 is in the forward position as seen in FIG. 4. When the bolt 110 moves rearward in direction A to assume the rearward position, the connector 134 and the generator magnet 136 also move rearward, as seen in FIG.

5. Simultaneously, the magnet 116 of the bolt 110 also moves relative to the conducting coil 108 of the first electromagnet unit 100, as seen in FIG. 5.

The movement of the generator magnet 136 relative to the generator coil 138 causes generation of an electromotive force (emf), i.e., a voltage is generated in the generator coil 138 in accordance with Faraday's law. This further leads to generation of an induction current in the generator coil 138. In some embodiments, the generator coil 138 is electrically connected to the power source 125 so as to provide the generated induction current to the power source 125, thereby charging the power source 125. Alternatively or additionally, the generator col 138 may be electrically connected to one or more other electrical devices (e.g., a red dot sight) to provide electrical power to power said one or more other electrical devices. It is appreciated that the direction of the flow of induction current may be predetermined based on the polarity of the generator magnet 136.

The second electromagnet unit 130 thus functions as an electric energy generator by virtue of the relative movement of the generator magnet 136 and the generator coil 138. In some embodiments, as described heretofore, the induced current in the generator coil 138 charges the power source 125, which further provides current to the conducting coil 108 of the recoil-absorbing first electromagnet unit 100. Accordingly, an efficient electromagnetic recoil control system comprising the first electromagnet unit 100 and the second electromagnet unit 130 is provided that can be utilized with the firearm 120 for efficiently reducing the recoil felt by a user at least partially by using energy generated by the movement of the bolt 110 itself.

Figure 6:
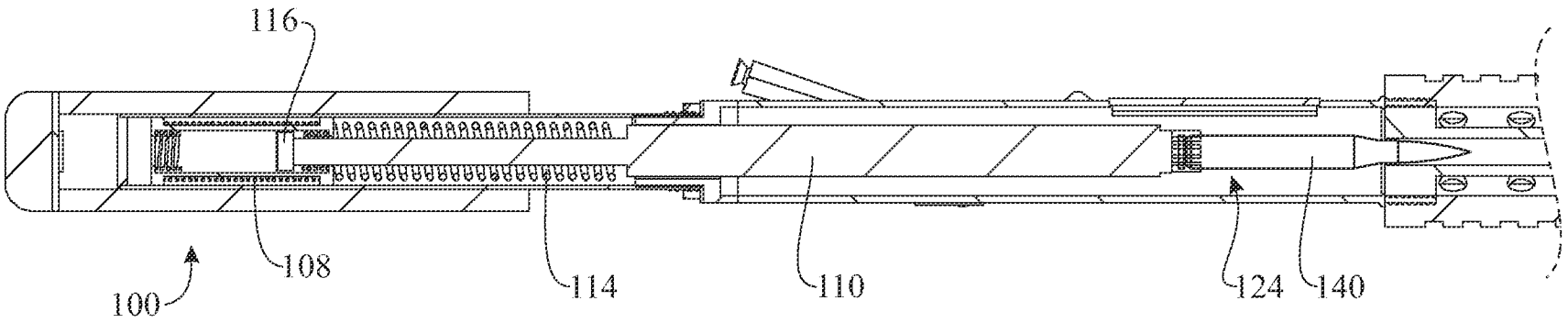
FIG. 6 illustrates a top sectional partial view of the firearm of FIG. 3 with a cartridge loaded in the firing chamber and the bolt in the forward position, in accordance with one embodiment of the present specification.
Figure 7:
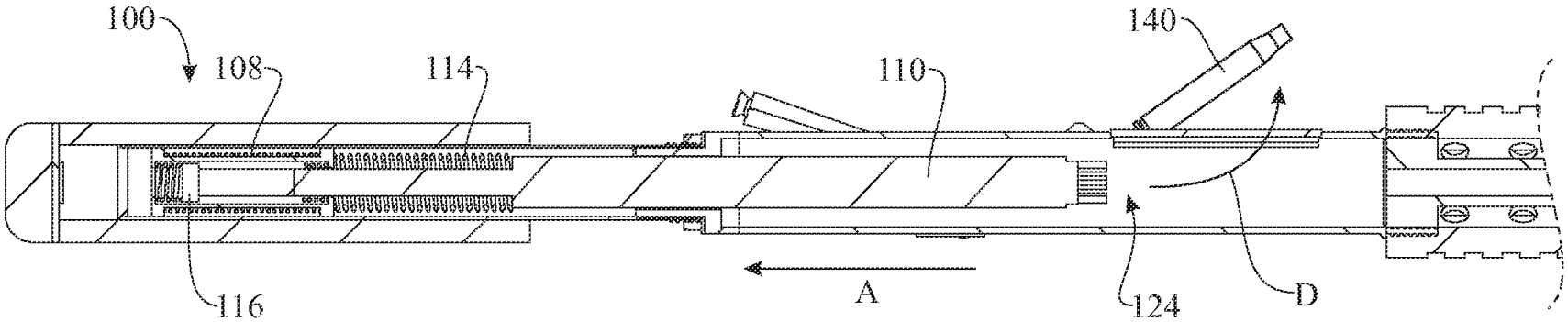
FIG. 7 illustrates a top sectional partial view of the firearm of FIG. 3 with a cartridge being extracted from the firing chamber and the bolt in the rearward position, in accordance with one embodiment of the present specification.

Reference is made to FIGS. 6-7 to illustrate the motion of the bolt 110 relative to the conducting coil 108 of the first electromagnet unit 100. The illustration of FIG. 6 shows a top sectional view of the firearm 120 in which a cartridge 140 with a bullet is loaded in the firing chamber 124. The bolt 110 is in the forward position and the recoil spring 114 is de-compressed. When the firearm is fired, the bullet escapes the firearm 120 through the barrel 122 (FIG. 3) as heretofore described, and the empty cartridge 140 is extracted from the firearm as shown by arrow D in FIG. 7. The bolt 110 moves rearward in direction A to facilitate extraction of the cartridge 140, and at the same time, the magnet 116 of the bolt 110 also moves rearward relative to and within the conducting coil 108.

The conducting coil 108 is electrically connected to the power source 125 (FIGS. 3-5) and current flows in the conducting coil 108 leading to a magnetic field which opposes the rearward motion of the magnet 116 and the bolt 110, thus reducing a recoil felt by a user firing the firearm. In some embodiments, the power source 125 is activated upon pressing of the trigger of the firearm, thus leading to flow of current in the conducting coil 108 in response to the firearm being fired.

Simultaneously with the movement of the magnet 116 relative to the conducting coil 108 of the first electromagnet unit 100, the second electromagnet unit 130 (FIGS. 3-5) also functions to generate electric energy. The connector 134 and the generator magnet 136 move together with the bolt 110, the movement of the generator magnet 136 being relative to the generator coil 138 and causing generation of an induced current in the generator coil 138. The induced current can then be provided to the power source 125 in order to charge the power source 125 and regain some of the energy being provided by the power source 125 to the conducting coil 108 of the first electromagnet unit 100. Alternatively or additionally, as described heretofore, the induced current may be provided to one or more electrical devices, such as, but not limited to, a red dot sight, in order to power said device(s) for operation, recharge said device(s), etc.

The first electromagnet unit 100 and the second electromagnet unit 130 thus form an electromagnetic system and function in tandem to reduce a recoil felt by the user firing the firearm as well as allow charging of the power source that is providing energy to reduce the recoil effects of the firearm. A user using a firearm having the electromagnetic system, or even one of the first electromagnet unit 100 and the second electromagnet unit 130, does not feel a hard recoil from firing the firearm.

Figure 8:
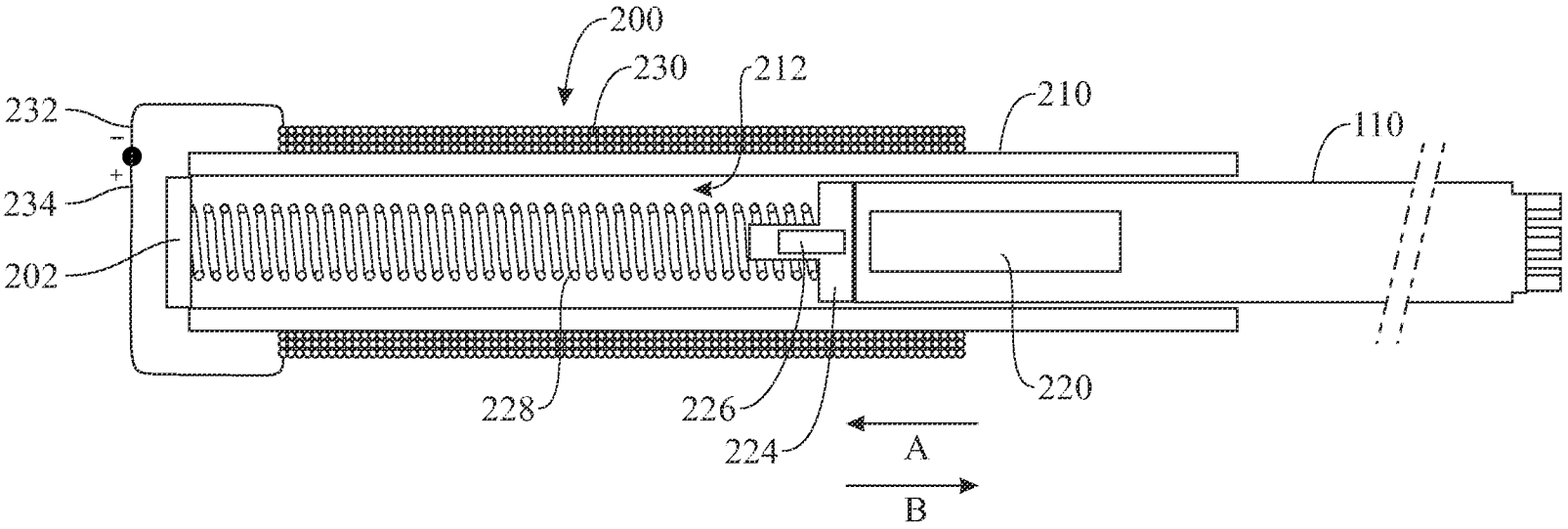
FIG. 8 presents a cross-sectional side elevation view of a recoil reducing, electromagnetic system in accordance with a further embodiment of the present invention.

The illustration of FIG. 8 shows a recoil-reducing electromagnetic system 200 in accordance with another embodiment of the present invention. Similarly to the previous embodiment, the electromagnetic system 200 is applicable to a bolt 110 which displaces axially within a firearm in a recoil or rearward direction A during firing. Similarly to the previous embodiment, the bolt 110 may be at least partially housed, and axially displaceable within a chamber or interior space 212 defined by a housing 210 of the electromagnetic system 200. As heretofore described with reference to previous embodiments, the housing 210 may be located, for instance and without limitation, inside the stock 128 (FIG. 3) of the firearm. In some embodiments, the housing 210 may be made generally of copper. Alternatively or additionally, as shown, the housing may be generally cylindrical. In some embodiments, a copper body or block 202 may be provided at a proximal or rear end of the housing 210, for purposes described hereinafter. Alternatively or additionally, the electromagnetic system 200 may include a piezoelectric sensor at the rear end of the housing 210, such as at reference numeral 202.

The bolt 110 of the present embodiment includes a permanent magnet, hereinafter referred to as magnet 220. The magnet 220 may be permanently or disconnectably attached to, embedded, contained within, or otherwise carried by the bolt 110, preferably at a rear end thereof as shown. Alternatively or additionally, a permanent magnet, hereinafter referred to as magnet 226, may be permanently or disconnectably attached to, embedded, contained within, or otherwise carried by a buffer weight 224, which is in turn attached to the bolt 110. A compression-type, buffer spring 228 may extend within the interior space 212 and may be configured to exert a force in direction B against the jointly-recoiling bolt 110 and buffer weight 224, allowing to reduce the recoil effect, similarly to as was heretofore described with reference to the recoil spring 114 and biasing means 105. In some embodiments, the buffer spring 228 may be in permanent contact with the buffer weight 224 and may compress and expand in contact with the buffer weight 224 as the bolt 110 and buffer weight 224 travel axially and jointly along direction A and direction B, respectively.

An electrically-conductive coil 230 may be wrapped around the housing 210. The electrically-conductive coil 230 is formed of a conducting material having a high electrical conductivity. Some non-limiting examples of materials for the electrically-conductive coil 230 include copper, copper-beryllium, copper coated aluminum, brass and aluminum alloy, etc. In some embodiments, the electrically-conductive coil 230 forms a solenoid. In some embodiments, the electrically-conductive coil 230 assumes a spiral or helix shape. In some embodiments, the electrically-conductive coil 230 may be formed of multiple coils. As shown, the opposite electrical ends 232, 234 of the electrically-conductive coil 230 may be connected to one another, i.e. the electrically-conductive coil 230 may be connected to itself.

In some embodiments, a controller unit or circuit (comprising a microcontroller, microprocessor, or the like) may control the electrical current fed to the electrically-conductive coil 230, and may allow for a manual or automatic adjustment of said current. In other embodiments, the electrical current fed to the electrically-conductive coil 230 may be fixed, or otherwise adjustable by hardware (e.g., a potentiometer).

In operation, during recoil of the bolt 110 as a result of firing the firearm, the bolt 110 and the magnets 220, 226 travel axially rearward (direction A) along the interior space 212 of the housing 210. By virtue of Lenz's law, the relative rearward movement of the magnets 220, 226 with respect to the non-powered and short-circuited electrically-conductive coil 230 causes the electrically-conductive coil 230 to generate an electromagnetic field which opposes the rearward movement of the magnets 220, 226 and, thereby, of the bolt 110; thus, the present embodiment allows to at least partially mitigate the recoil of the firearm without the need for electrical power. In addition, the compression-type, buffer spring 228 exerts a force in direction B on the buffer weight 224 which further opposes the recoil of the bolt 110. Furthermore, when the bolt 110 and attached parts reach the rear end of the interior space 212, the copper block 202 slows the magnet 226 and thus contributes to reducing the recoil at the rearmost positions of the bolt 110 along the interior space 212. Finally, in embodiments provided with a piezoelectric sensor at the rear end of the housing, the buffer weight may impact the piezoelectric sensor when reaching the rear end of the housing, and the piezoelectric sensor may measure the dynamic pressure exerted thereon by the buffer weight to monitor the speed of the bolt 110 and the overall performance of the electromagnetic system 200. In some embodiments, the controller may responsively and automatically adjust the electromagnetic system 200 (e.g., the electrical current and induced magnetic field) in order to adjust (e.g., further decrease) the speed of the bolt 110, for example, the controller may switch the electromagnetic system 200 to instead connect the ends 232, 234 of the electrically-conductive coil 230 to a power source (e.g., power source 125) and adjust the electrical current provided by the power source 125 to the electrically-conductive coil 230 to adjust the magnetic field generated by the electrically-conductive coil 230.

Figure 9:
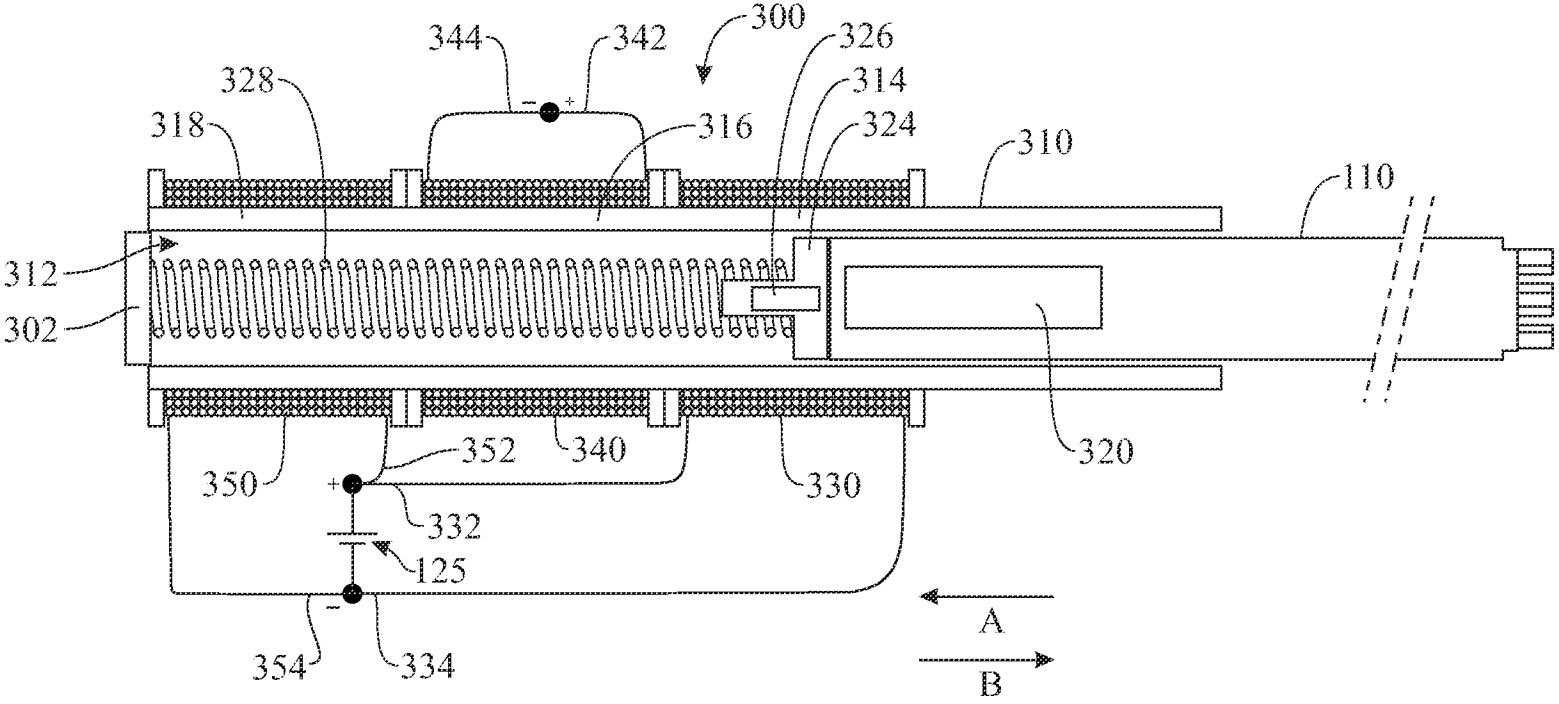
FIG. 9 presents a cross-sectional side elevation view of a recoil reducing, electromagnetic system in accordance with another embodiment of the present invention.

The illustration of FIG. 9 shows a recoil-reducing electromagnetic system 300 in accordance with another embodiment of the present invention. Similarly to the previous embodiments, the electromagnetic system 300 is applicable to a bolt 110 which displaces axially within a firearm in a recoil or rearward direction A during firing. Similarly to the previous embodiment, the bolt 110 may be at least partially housed, and axially displaceable within a chamber or interior space 312 defined by a housing 310 of the electromagnetic system 300. As heretofore described with reference to previous embodiments, the housing 310 may be located, for instance and without limitation, inside the stock 128 (FIG. 3) of the firearm. In some embodiments, the housing 310 may be made generally of copper. Alternatively or additionally, as shown, the housing may be generally cylindrical. In some embodiments, a copper body or block 302 may be provided at a proximal or rear end of the housing 310, similarly to the previous embodiment. Alternatively or additionally, the electromagnetic system 300 may include a piezoelectric sensor at the rear end of the housing 310, such as at reference numeral 302.

Also similarly to the previous embodiment, the bolt 110 of the present embodiment includes a permanent magnet, hereinafter referred to as magnet 320. The magnet 320 may be permanently or disconnectably attached to, embedded, contained within, or otherwise carried by the bolt 110, preferably at a rear end thereof as shown. Alternatively or additionally, a permanent magnet, hereinafter referred to as magnet 326, may be permanently or disconnectably attached to, embedded, contained within, or otherwise carried by a buffer weight 324, which is in turn attached to the bolt 110. A compression-type, buffer spring 328 may extend within the interior space 312 and may be configured to exert a force in direction B against the jointly-recoiling bolt 110 and buffer weight 324, allowing to reduce the recoil effect, similarly to as was heretofore described with reference to the recoil spring 114 and biasing means 105. In some embodiments, the buffer spring 328 may be in permanent contact with the buffer weight 324 and may compress and expand in contact with the buffer weight 324 as the bolt 110 and buffer weight 324 travel axially and jointly along direction A and direction B, respectively.

The electromagnetic system 300 may further include two or more electrically-conductive coils wrapped around the housing 310 at different axial positions or areas along the housing 310, allowing to create different dampening or recoil-reducing effects at said each different axial position along the housing 310. For example, the electromagnetic system 300 depicted herein specifically includes front or first electrically-conductive coil 330, an intermediate or second electrically-conductive coil 340, and a rear or third electrically-conductive coil 350, which are wrapped around the housing 310 at a front area 314, intermediate area 316, and rear area 318 of the housing 310, respectively. In some embodiments, such as the present embodiment, the plurality of electrically-conductive coils may be arranged consecutively along the axial direction, without overlapping with each other. Each one of the first, second and third electrically-conductive coils 330, 340, and 350, respectively, may be formed of a conducting material having a high electrical conductivity. Some non-limiting examples of materials include copper, copper-beryllium, copper coated aluminum, brass and aluminum alloy, etc. In some embodiments, at least one of the first, second, and third electrically-conductive coils 330, 340, 350 forms a solenoid. In some embodiments, at least one of the first, second, and third electrically-conductive coils 330, 340, 350 assumes a spiral or helix shape.

The plurality of electrically-conductive coils may be independently configured with respect to each other. For example, the first and third electrically-conductive coils 330 and 350 of the present embodiment are electrically connected to a power source (e.g., power source 125); more specifically, respective first ends 332 and 352 of the first and third electrically-conductive coils 330 and 350 are electrically connected to a positive terminal of the electrical power source 125, and opposite, respective second ends 334 and 354 of the first and third electrically-conductive coils 330 and 350 are electrically connected to a negative terminal of the electrical power source 125. The electrical power source 125 thereby generates an electrical current at the first and third electrically-conductive coils 330 and 350, the electrical current inducing a respective magnetic field within each of the first and third electrically-conductive coils 330 and 350. As to the second electrically-conductive coil 340, first and second ends 342 and 344 thereof may be electrically connected to one another, as shown. Alternative embodiments are contemplated without departing from the scope of the present disclosure. For example, the number of axially consecutive electrically-conductive coils may vary. The electrical connection of the first and second ends of each electrically-conductive coil may vary; for example, the first and second ends may be connected to each other (as described with reference to the second electrically-conductive coil 340), or to a power source (as described with reference to the first and third electrically-conductive coils 330 and 350). Furthermore, the electrical current and magnetic field generated at each coil may vary.

In some embodiments, a controller unit or circuit (comprising a microcontroller, microprocessor, or the like) may control the electrical current fed to the electrically-conductive coil or coils, and may allow for a manual or automatic adjustment of said current. In other embodiments, the electrical current fed to the electrically-conductive coil or coils may be fixed, or otherwise adjustable by hardware (e.g., a potentiometer).

In operation, during recoil of the bolt 110 as a result of firing the firearm, the bolt 110 and the magnets 320, 326 travel axially rearward (direction A) along the interior space 312 of the housing 310. As the bolt 110 travels along the consecutive areas 314, 316, 318 of the housing 310 associated with the different electrically-conductive coils 330, 340, 350, the magnets 320, 326 may be magnetically opposed in different ways depending on the area and thus the recoil reducing effect on the bolt 110 may vary from one area to another. For example, as the bolt 110 travels along the front area 314, a magnetic field generated by the electrical current flowing through the first electrically-conductive coil 330, as powered by the power source 125, may repel the magnets 320, 326 and oppose the recoiling movement of the bolt 110, slowing down the bolt 110. Next, as the bolt 110 travels along the intermediate area 316, as with the electrically-conductive coil 230 of the previous embodiments, the relative rearward movement of the magnets 320, 326 with respect to the non-powered and short-circuited, second electrically-conductive coil 340 causes the second electrically-conductive coil 340 to generate an electromagnetic field which opposes the rearward movement of the magnets 320, 326 and, thereby, of the bolt 110, thereby dampening the recoil. Finally, as the bolt 110 travels along the rear area 328, a magnetic field generated by the electrical current flowing through the third electrically-conductive coil 350, as powered by the power source 125, may repel the magnets 320, 326 and oppose the recoiling movement of the bolt 110, further slowing down the bolt 110. In some embodiments, the second electrically-conductive coil 340 may be configured such that the recoil of the bolt 110 is softened or reduced to a lesser extent than at the first and third electrically-conductive coils 330 and 350, i.e. such that the slowing-down effect is stronger at the first and third electrically-conductive coils 330 and 350.

In addition, the compression-type, buffer spring 328 exerts a force in direction B on the buffer weight 324 which further opposes the recoil of the bolt 110. Furthermore, when the bolt 110 and attached parts reach the rear end of the interior space 312, the copper block 302 slows the magnet 326 and thus contributes to reducing the recoil at the rearmost positions of the bolt 110 along the interior space 312. Finally, in embodiments provided with a piezoelectric sensor at the rear end of the housing, the buffer weight may impact the piezoelectric sensor when reaching the rear end of the housing, and the piezoelectric sensor may measure the dynamic pressure exerted thereon by the buffer weight to monitor the speed of the bolt 110 and the overall performance of the electromagnetic system 300. In some embodiments, the controller may responsively and automatically adjust the electromagnetic system 300 in order to adjust the speed of the bolt 110. For example, the controller may adjust the electrical current fed to either one of the first and third electrically-conductive coils 330 and 350 to vary the resulting, induced magnetic field and thereby adjust (e.g., further decrease) the recoil of the bolt 110. In another example, the controller may switch the electromagnetic system 300 to connect the ends 342, 344 of the second electrically-conductive coil 340 to the power source 125, and adjust the electrical current provided by the power source 125 to the electrically-conductive coil 330 to adjust the magnetic field generated by the electrically-conductive coil 330. In yet another example, the controller may switch either one of the first and third electrically-conductive coils 330 and 350 such that their respective ends 332-334, 352-354 are connected to one another instead of to the power source 125. In summary, by dividing the electrically-conductive coil into a plurality of axially consecutive coils, each one potentially featuring (and, in some embodiments, adjustable, such as automatically adjustable to) a different electrical behavior, the electromagnetic system 300 may provide a different dampening effect at each coil, i.e. at different lengths of travel of the bolt 110 within the interior space 312, and thus at different axial positions of the recoiling bolt 110.

Figure 10:
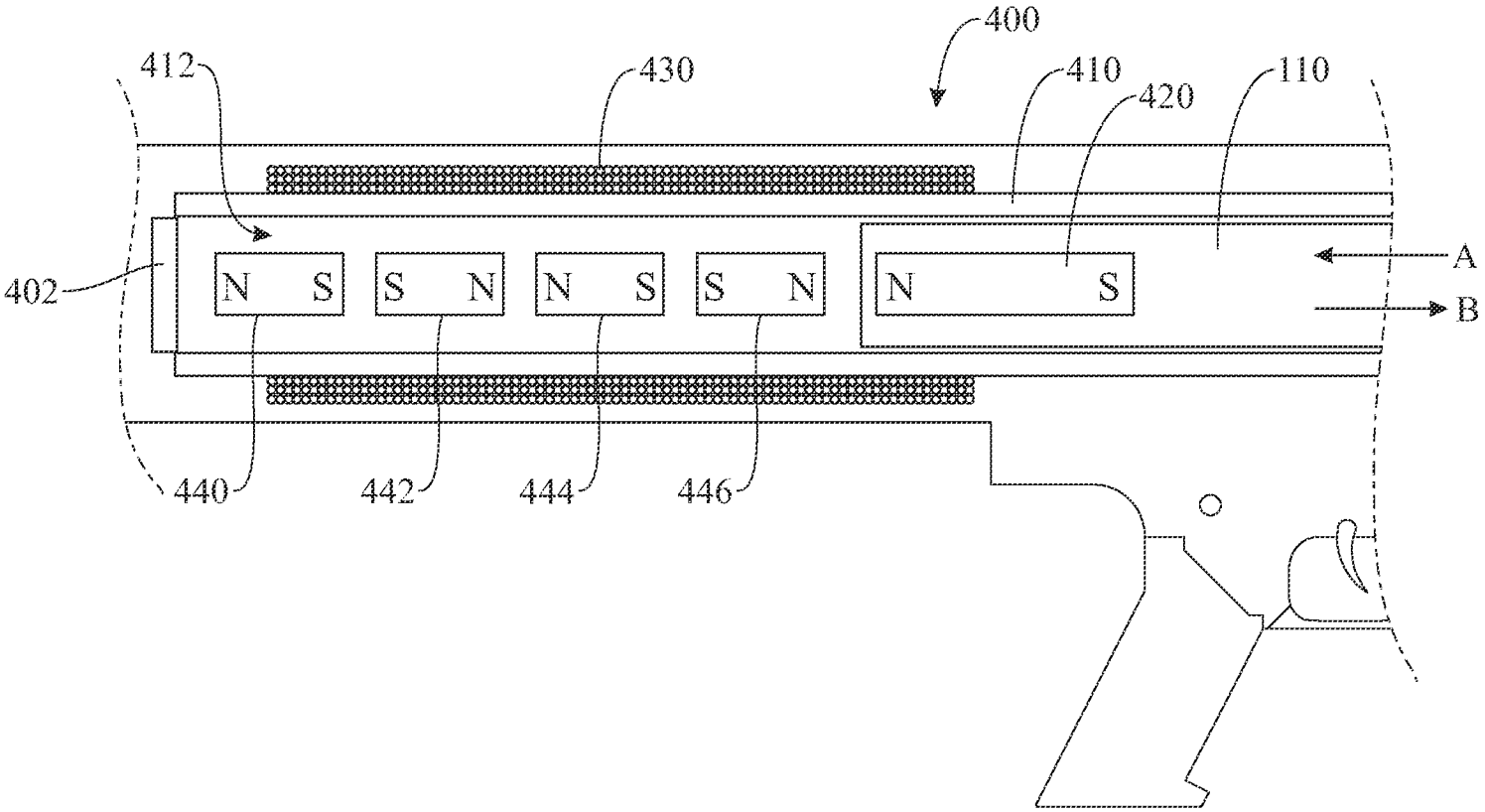
FIG. 10 presents a cross-sectional side elevation view of a recoil reducing, electromagnetic system in accordance with yet another embodiment of the present invention.

The illustration of FIG. 10 shows a recoil-reducing electromagnetic system 400 in accordance with another embodiment of the present invention. Similarly to the previous embodiments, the electromagnetic system 400 is applicable to a bolt 110 which displaces axially within a firearm in a recoil or rearward direction A during firing. Also similarly to the previous embodiments, the bolt 110 may be at least partially housed, and axially displaceable within a chamber or interior space 412 defined by a housing 410 of the electromagnetic system 400. As heretofore described with reference to previous embodiments, the housing 410 may be located, for instance and without limitation, inside the stock 128 (FIG. 3) of the firearm. In some embodiments, the housing 410 may be made generally of copper. Alternatively or additionally, as shown, the housing may be generally cylindrical. In some embodiments, a copper body or block 402 may be provided at a proximal or rear end of the housing 410. Alternatively or additionally, the electromagnetic system 400 may include a piezoelectric sensor at the rear end of the housing 410, such as at reference numeral 402.

Similarly to previous embodiments, the bolt 110 of the present embodiment includes a permanent magnet, hereinafter referred to as magnet 420. The magnet 420 may be permanently or disconnectably attached to, embedded, contained within, or otherwise carried by the bolt 110, preferably at a rear end thereof as shown. An electrically-conductive coil 430 may be wrapped around the housing 410. The electrically-conductive coil 430 is formed of a conducting material having a high electrical conductivity. Some non-limiting examples of materials for the electrically-conductive coil 430 include copper, copper-beryllium, copper coated aluminum, brass and aluminum alloy, etc. In some embodiments, the electrically-conductive coil 430 forms a solenoid. In some embodiments, the electrically-conductive coil 430 assumes a spiral or helix shape. In some embodiments, the electrically-conductive coil 430 may be formed of multiple coils. In different embodiments, the opposite electrical ends of the electrically-conductive coil 430 may be connected to one another or to a power source (e.g., power source 125). In some embodiments, a controller unit or circuit (comprising a microcontroller, microprocessor, or the like) may control the electrical current fed to the electrically-conductive coil 430, and may allow for a manual or automatic adjustment of said current. In other embodiments, the electrical current fed to the electrically-conductive coil 430 may be fixed, or otherwise adjustable by hardware (e.g., a potentiometer).

The electromagnetic system 400 of the present embodiment further includes a plurality of discrete, spaced-apart, permanent magnets contained within the housing 410. Preferably, the plurality of magnets are arranged in axial consecutive alignment along the interior space 412 and free to move axially (i.e., axially "floating"). In the non-limiting example shown in the drawing, the plurality of permanent magnets specifically consists of four magnets 440, 442, 444, and 446. The four magnets 440, 442, 444, and 446 are arranged in axial consecutive alignment, preferably spaced-apart from one another, and with the polarities of the respective opposite ends of each magnet facing a same polarity of the adjacent magnet(s), such that each pair of adjacent magnets are repelled from one another. Furthermore, the magnet 420 of the bolt 110 is oriented such that a polarity of the magnet 420 faces a same polarity of the adjacent magnet of the plurality of magnets (in the present embodiment, of the fourth magnet 446) such that the bolt 110 and the adjacent magnet (fourth magnet 446) are repelled from each other. In some embodiments, such as the present embodiment, the plurality of magnets (e.g., the four magnets) may be provided instead of a buffer spring and buffer weight as described with reference to FIG. 8.

In operation, during recoil of the bolt 110 as a result of firing the firearm, the bolt 110 and the magnet 420 travel axially rearward (direction A) along the interior space 412 of the housing 410. In embodiments in which the opposite electrical ends of the electrically-conductive coil 430 are connected to one another, as with the electrically-conductive coils 230, 340 of the previous embodiments, the relative rearward movement of the magnet 420 with respect to the non-powered and short-circuited electrically-conductive coil 430 causes the electrically-conductive coil 430 to generate an electromagnetic field which opposes the rearward movement of the magnet 420 and, thereby, of the bolt 110, without the need for electrical power. In embodiments in which the opposite electrical ends of the electrically-conductive coil 430 are instead connected to a power source (e.g., power source 125), a magnetic field generated by the electrical current flowing through the electrically-conductive coil 430, as powered by the power source 125, may repel the magnet 420 and oppose the recoiling movement of the bolt 110, slowing down the bolt 110.

In addition, adjacent magnets of the axially aligned, plurality of magnets 440, 442, 444, 446 and magnet 420 may repel each other and thereby generate an overall axial force on magnet 420 which is at least partially directed frontward, i.e. in direction B, further opposing the recoil of the bolt 110 in direction A. Furthermore, when the bolt 110 and attached parts reach the rear end of the interior space 412, the copper block 402 may contribute to slowing the magnet 420 and thus reducing the recoil at the rearmost positions of the bolt 110 along the interior space 412.

In some embodiments, the coils which are connected to a power source (e.g., electrically-conductive coils 108, 330, 350, 430) may be made of steel, whereas the coil(s) having ends connected to each other (e.g., electrically-conductive coils 230, 340, 430) may be made of copper. Such a configuration may provide optimal results regarding the slowing-down effect provided by the former and the softening effect provided by the latter, particularly when including both types of connections in a same embodiment (FIG. 9).

Further embodiments are contemplated without departing from the scope of the present disclosure. For example, it is contemplated that the electromagnetic systems 200, 300 and 400 of FIGS. 8, 9 and 10, respectively, may further include a second electromagnetic unit 130 as described with reference to FIGS. 1-7.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An electromagnetic system coupled to a firearm, the firearm comprising a bolt movable rearward and frontward along a rear-to-front, axial direction between a forward position and a rearward position, the electromagnetic system comprising:

a first electromagnet unit comprising:

at least one electrically-conductive coil, and at least one magnet, movable jointly with the bolt in the axial direction with respect to the at least one electrically-conductive coil, wherein the at least one electrically-conductive coil is configured to generate at least one magnetic field that opposes a rearward movement of the at least one magnet in the axial direction and thereby reduces a rearward recoil of the bolt.

2. The electromagnetic system of claim 1, wherein the bolt and the at least one magnet are axially movable through the at least one electrically-conductive coil.

3. The electromagnetic system of claim 2, further comprising a housing defining an interior space, the housing and interior space elongately formed along the axial direction, wherein the bolt and the at least one magnet are jointly movable in the axial direction within the interior space and relative to the housing, and further wherein the at least one electrically-conductive coil is wound over and around the housing.

4. The electromagnetic system of claim 3, further comprising a plurality of magnets arranged axially consecutive within the interior space, wherein adjacent magnets of the plurality of magnets are configured to repel each other, and further wherein a frontmost magnet of the plurality of magnets is configured to repel the at least one magnet of the first electromagnet unit.

5. The electromagnetic system of claim 3, wherein the housing and the at least one electrically-conductive coil are carried by a stock of the firearm.

6. The electromagnetic system of claim 5, wherein the housing and the at least one electrically-conductive coil are contained within the stock.

7. The electromagnetic system of claim 1, wherein the at least one electrically-conductive coil comprises a non-powered electrically-conductive coil with opposite ends short-circuited to one another.

8. The electromagnetic system of claim 1, wherein the at least one electrically-conductive coil comprises a powered electrically-conductive coil connected to an electrical power source, the electrical power source configured to produce an electrical current along the powered electrically-conductive coil, wherein said magnetic field is generated by said electrical current.

9. The electromagnetic system of claim 8, wherein the electrical power source is carried by the firearm.

10. The electromagnetic system of claim 8, wherein the electrical power source is configured to produce said electrical current responsively to firing the firearm.

11. The electromagnetic system of claim 8, wherein the electrical current is adjustable.

12. The electromagnetic system of claim 8, further comprising:

a second electromagnet unit comprising:

an electrically-conductive, generator coil electrically connected to the electrical power source, a magnet, and a connector connecting the magnet of the second electromagnet unit to the bolt such that the magnet of the second electromagnet unit and the bolt are movable jointly in the axial direction with respect to the electrically-conductive, generator coil, wherein the movement of the magnet of the second electromagnet unit is configured to produce an induced current in the generator coil, the induced current feedable to the electrical power source.

13. The electromagnetic system of claim 1, wherein the at least one electrically-conductive coil comprises a plurality of electrically-conductive coils arranged consecutively along the axial direction, wherein each electrically-conductive coil of the plurality of electrically-conductive coils is configured to generate a respective magnetic field of the at least one magnetic field.

14. The electromagnetic system of claim 13, wherein not all said respective magnetic fields are equal.

15. The electromagnetic system of claim 13, wherein the plurality of electrically-conductive coils comprises one or more non-powered electrically-conductive coils and one or more powered electrically-conductive coils, wherein opposite ends of each non-powered electrically-conductive coils are short-circuited to one another, and wherein the one or more powered electrically-conductive coils are connected to an electrical power source, the electrical power source operable to produce a respective electrical current through each powered electrically-conductive coil of the one or more powered electrically-conductive coils, wherein each of the one or more non-powered electrically-conductive coils and the one or more powered electrically-conductive coils generates a respective magnetic field of the at least one magnetic field.

16. The electromagnetic system of claim 15, wherein the one or more powered electrically-conductive coils comprise a front electrically-conductive coil and a rear electrically-conductive coil axially spaced apart from one another, and the one or more non-powered electrically-conductive coils comprise an intermediate electrically-conductive coil arranged axially between the front and rear electrically-conductive coils.

17. The electromagnetic system of claim 1, further comprising:

a second electromagnet unit comprising:

an electrically-conductive, generator coil electrically connected to an electrical device, a magnet, and a connector connecting the magnet to the bolt such that the magnet and the bolt are movable jointly in the axial direction with respect to the electrically-conductive, generator coil, wherein the movement of the generator magnet is configured to produce an induced current in the generator coil, the induced current feedable to the electrical device.

18. The electromagnetic system of claim 17, wherein the generator coil and magnet are arranged radially offset from the bolt with respect to a central longitudinal axis of the bolt and adjacent a firing chamber of the firearm.

19. An electromagnetic system coupled to a firearm, the firearm comprising a bolt movable rearward and frontward along a rear-to-front, axial direction between a forward position and a rearward position, the electromagnetic system comprising:

a first electromagnet unit comprising:

a housing defining an interior space, the housing and interior space elongately formed along the axial direction, at least one electrically-conductive coil wound over and around the housing, and at least one magnet, movable jointly with the bolt in the axial direction with respect to and through the at least one electrically-conductive coil, and within the interior space and relative to the housing, wherein the at least one electrically-conductive coil is configured to generate at least one magnetic field that opposes a rearward movement of the at least one magnet in the axial direction and thereby reduces a rearward recoil of the bolt.

20. An electromagnetic system coupled to a firearm, the firearm comprising a bolt movable rearward and frontward along a rear-to-front, axial direction between a forward position and a rearward position, the electromagnetic system comprising:

an electrical power source, carried by the firearm;

a first electromagnet unit comprising:

a housing defining an interior space, the housing and interior space elongately formed along the axial direction, at least one electrically-conductive coil wound over and around the housing, the at least one electrically-conductive coil connected to the electrical power source, and at least one magnet, movable jointly with the bolt in the axial direction with respect to and through the at least one electrically-conductive coil, and within the interior space and relative to the housing, wherein the at least one electrically-conductive coil is configured to generate at least one magnetic field responsively to an electrical current generated by the electrical power source flowing through the at least one electrically-conductive coil, wherein the at least one magnetic field opposes a rearward movement of the at least one magnet in the axial direction and thereby reduces a rearward recoil of the bolt; and a second electromagnet unit comprising:

an electrically-conductive, generator coil electrically connected to the electrical power source, a magnet, and a connector connecting the magnet of the second electromagnet unit to the bolt such that the magnet of the second electromagnet unit and the bolt are movable jointly in the axial direction with respect to the electrically-conductive, generator coil, wherein the movement of the magnet of the second electromagnet unit is configured to produce an induced current in the generator coil, the induced current feedable to the electrical power source.

* * * * *